US010636388B2

(12) United States Patent
Shinozaki

(10) Patent No.: US 10,636,388 B2
(45) Date of Patent: Apr. 28, 2020

(54) DISPLAY DEVICE, DISPLAY METHOD, AND STORAGE MEDIUM

(71) Applicant: CASIO COMPUTER CO., LTD., Shibuya-ku, Tokyo (JP)

(72) Inventor: Yoshihiko Shinozaki, Tachikawa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/890,802

(22) Filed: Feb. 7, 2018

(65) Prior Publication Data

US 2018/0277062 A1 Sep. 27, 2018

(30) Foreign Application Priority Data

Mar. 24, 2017 (JP) ..... 2017-059662

(51) Int. Cl.

| | |
|---|---|
| ***G09G 5/00*** | (2006.01) |
| ***G09G 5/14*** | (2006.01) |
| ***G09G 5/28*** | (2006.01) |
| ***G09G 3/00*** | (2006.01) |

(52) U.S. Cl.

CPC ..... *G09G 5/28* (2013.01); *G09G 3/001* (2013.01); *G09G 5/005* (2013.01); *G09G 5/14* (2013.01); *G09G 2340/04* (2013.01); *G09G 2370/12* (2013.01); *G09G 2370/16* (2013.01); *G09G 2370/20* (2013.01)

(58) Field of Classification Search

None

See application file for complete search history.

(56) References Cited

U.S. PATENT DOCUMENTS

| | | | | |
|---|---|---|---|---|
| 9,324,295 | B2 | 4/2016 | Kubota et al. | |
| 9,430,989 | B2 | 8/2016 | Aoshima et al. | |
| 9,497,405 | B2 | 11/2016 | Kenmochi | |
| 2006/0015813 | A1* | 1/2006 | Chung | G06F 17/214 715/201 |
| 2010/0188419 | A1* | 7/2010 | Ratnakar | G06K 9/033 345/619 |
| 2011/0066259 | A1* | 3/2011 | Suzuki | G05B 15/02 700/83 |
| 2014/0208196 | A1* | 7/2014 | Wayman | G06F 17/211 715/234 |
| 2015/0124170 | A1* | 5/2015 | Kenmochi | H04N 21/426 348/564 |

FOREIGN PATENT DOCUMENTS

| | | | |
|---|---|---|---|
| JP | 2014052930 | A | 3/2014 |
| JP | 2014071377 | A | 4/2014 |
| WO | 2014013979 | A1 | 1/2014 |

* cited by examiner

*Primary Examiner* — Ke Xiao
*Assistant Examiner* — Jed-Justin Imperial
(74) *Attorney, Agent, or Firm* — Holtz, Holtz & Volek PC

(57) ABSTRACT

There is provided a display device including: an input unit used to input a plurality of image signals from a plurality of external apparatuses; a display unit which displays images; a setting unit which sets a display condition of each of the plurality of images based on an aspect ratio corresponding to each of the plurality of image signals input through the input unit; and a display control unit which generates a composite image from the plurality of image signals input through the input unit based on the contents set by the setting unit, and displays the composite image on the display unit.

12 Claims, 4 Drawing Sheets

DISPLAY DEVICE, DISPLAY METHOD, AND STORAGE MEDIUM

BACKGROUND OF THE INVENTION

1. Field of the Invention

The present invention relates to a display device, a display method, and a storage medium suitable for a projector or the like, which receives a plurality of image signals as input to project a composite image.

2. Description of the Related Art

In Japanese Patent Application Laid-Open No. 2014-052930, a projector is proposed, which is connected to a plurality of (e.g., four) personal computers as external apparatuses to receive input image signals and split a screen based on the image signals input respectively from the personal computers in order to project the plurality of images simultaneously.

In general, when a plurality of input images are projected in a split manner on one screen, the screen on which the images are to be projected is equally split to arrange the plurality of images on respective split screens in order to display the plurality of images simultaneously.

In the meantime, the aspect ratio of each split screen is fixed, whereas the aspect ratio of each image input from a personal computer or the like and assigned to the screen position widely varies. For example, many video signals are horizontally long such as an aspect ratio of 4:3 or 16:9. On the other hand, many document images are horizontal long such as an aspect ratio of 1.41:1, or vertically long such as an aspect ratio of 1:1.41, in relation to paper size.

Then, when the split screen region is different from the aspect ratio of an image input from a personal computer or the like and to be projected into the region, it is common practice to set, as non-projection regions into which information is not projected, plain regions in preset safe color, such as black or blue, up and down or right and left on the split screen to make the entire input image appear on the split screen.

Therefore, when a projection is performed based on a plurality of image signals input from personal computers or the like, the ratio of the non-projection regions on the screen may be high depending on the type of image signal to be projected. In such a case, there is a possibility that the area of a significant portion will be relatively small in the projected image although the image is enlarged and projected from a projector, making the projection content hard to see.

The present invention has been made in view of the above circumstances, and it is an object thereof to provide a display device, a display method, and a storage medium, capable of reducing the area of non-projection regions as much as possible according to a plurality of input image signals to make effective use of the area of a screen.

SUMMARY OF THE INVENTION

According to one aspect of the present invention, a display device includes: an input unit used to input a plurality of image signals from a plurality of external apparatuses; a display unit which displays images; a setting unit which sets a display condition of each of the plurality of images based on an aspect ratio corresponding to each of the plurality of image signals input through the input unit; and a display control unit which generates a composite image from the plurality of image signals input through the input unit based on the contents set by the setting unit, and displays the composite image on the display unit.

According to another aspect of the present invention, there is provided a display method for a device including an input unit used to input a plurality of image signals from a plurality of external apparatuses and a display unit which displays images, the display method including: a setting step of setting a display condition of each of the plurality of images based on an aspect ratio corresponding to each of the plurality of image signals input through the input unit; and a display control step of generating a composite image from the plurality of image signals input through the input unit based on the contents set in the setting step, and displaying the composite image on the display unit.

According to still another aspect of the present invention, there is provided a storage medium readable by a computer incorporated in a device including an input unit used to input a plurality of image signals from a plurality of external apparatuses and a display unit which displays images, the computer being caused to function as: a setting unit which sets a display condition of each of the plurality of images based on an aspect ratio corresponding to each of the plurality of image signals input through the input unit; and a display control unit which generates a composite image from the plurality of image signals input through the input unit based on the contents set by the setting unit, and displays the composite image on the display unit.

DETAILED DESCRIPTION OF THE INVENTION

One embodiment of the present invention when a presentation is made in a projection environment using a projector will be described below with reference to the accompanying drawings.

Figure 1:
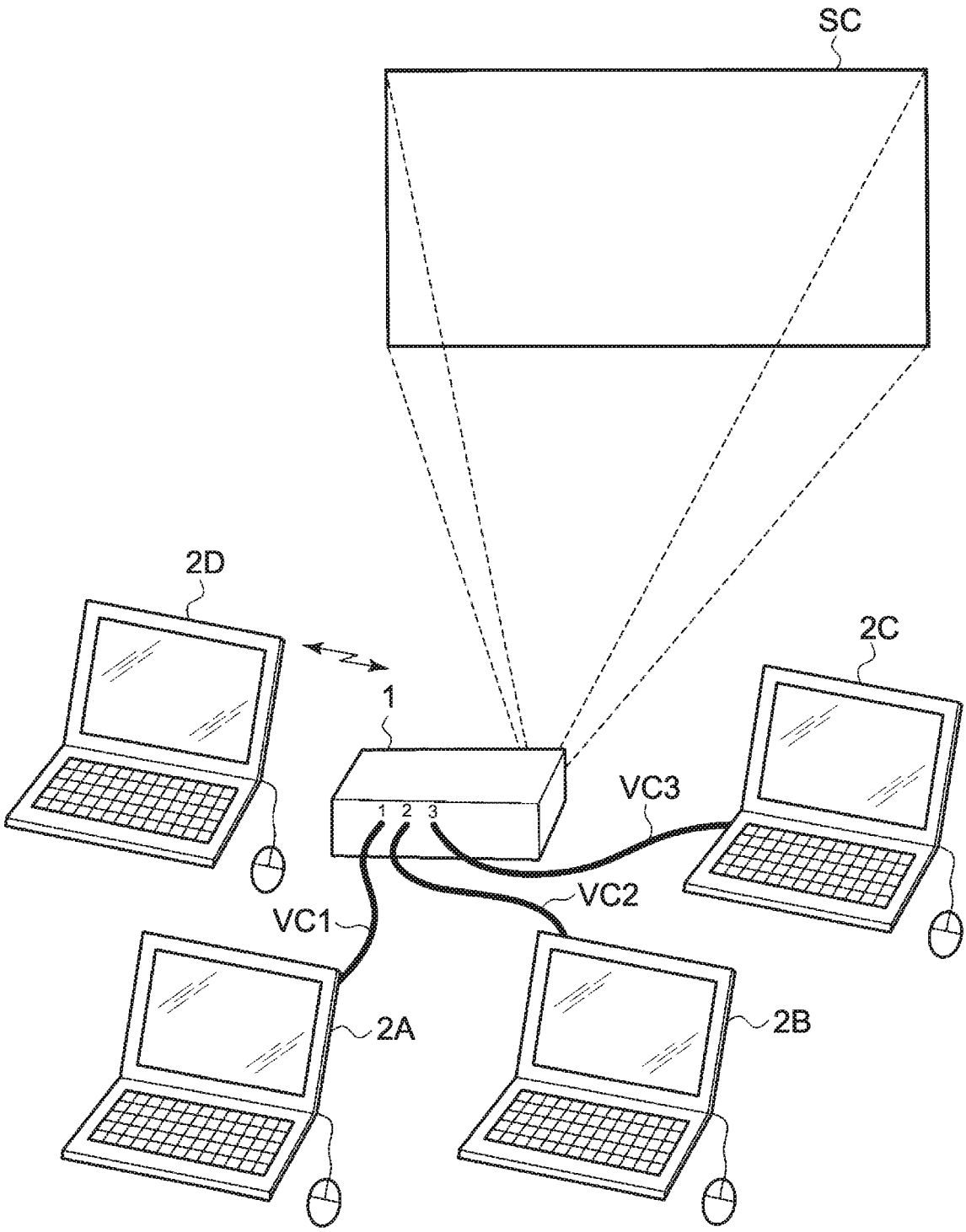
FIG. 1 is a diagram illustrating a projection environment using a projector according to one embodiment of the present invention.

FIG. 1 is a diagram illustrating the projection environment. In FIG. 1, reference numeral 1 denotes a projector, and reference numerals 2A to 2D denote personal computers (hereinafter abbreviated as "PCs") which provide, to the projector 1, images to be projected, respectively.

The projector 1 and three PCs (external apparatuses) 2A to 2C are wire-connected through video cables VC1 to VC3 for image signals and audio signals in conformity to respective standards such as the HDMI (registered trademark) (High-Definition Multimedia Interface) standards.

The PC (external apparatus) 2D mentioned above is wirelessly connected to the projector 1 by wireless LAN technology in conformity to the IEEE802.11a/11b/11g/11n standards, for example.

The projector 1 receives image data, file data for a specific application program, and the like given from these PCs 2A to 2D, and projects, on a screen SC as needed, a projected image based on these data, i.e., obtained by synthesizing four images here.

Figure 2:
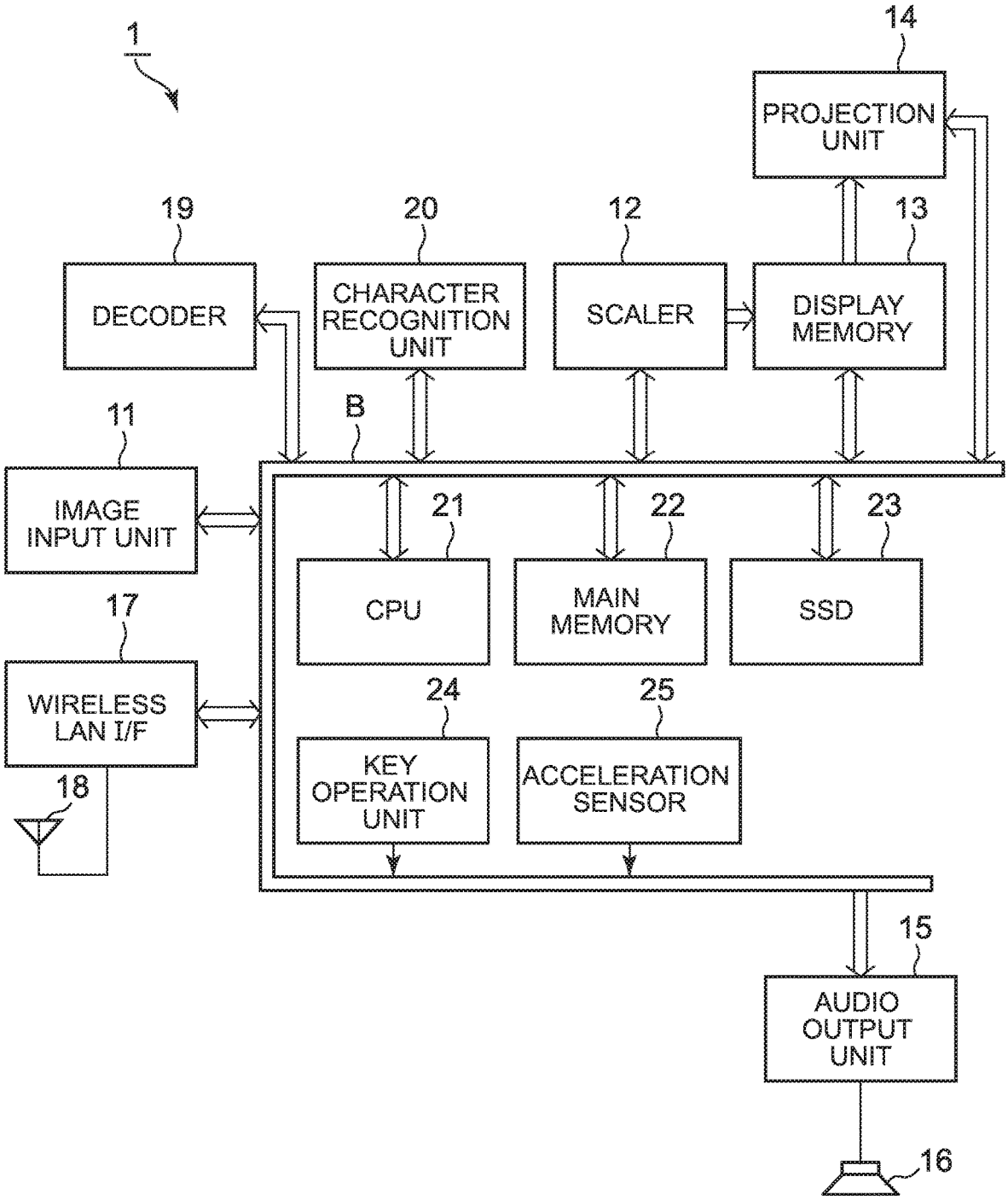
FIG. 2 is a block diagram illustrating a schematic functional configuration of the projector according to the embodiment.

FIG. 2 is a block diagram illustrating a schematic functional configuration of the projector 1. An image input unit 11 includes a plurality of (e.g., three) input terminals, for example, a D-sub15 type RGB input terminal, a pin-jack (RCA) type RGB input terminal, and an audio input terminal, an HDMI (registered trademark) terminal, a USB terminal, and the like. Image signals of various standards input to the image input unit 11 are converted to digital data as necessary in the image input unit 11, and sent to a scaler 12 through a bus B.

The scaler 12 consolidates image data, for example, up to four lines input through the bus B into image data in a predetermined format suitable for projection, respectively, and writes the image data to a display memory 13 as needed.

Based on the image data written in this display memory 13, a projection unit 14 performs a projection.

This projection unit 14 includes, for example, a micromirror element as a display element and its drive circuit, a light source unit having LEDs of three primary colors emit in a time-division manner, and a projection lens optical system which projects, toward the screen SC, an optical image as reflected light obtained by irradiating the light from the light source unit on the micromirror element.

On the micromirror element, the inclination angles of a plurality of micro mirrors arranged in a rectangular array, for example, for 4K UHDTV (3840 pixels×2160 lines) are turned on/off individually at high speed to form an optical image from the reflected light.

An audio signal input together with an image signal input to the image input unit 11 is converted to digital data as necessary, and separated from image data and given to an audio output unit 15. The audio output unit 15 includes a sound source circuit such as a PCM sound source to convert audio data to be given during projection into analogy data, drives a speaker unit 16 to amplify and output sound, and generate a beep or the like as necessary. The data sent from the PC 2D wirelessly are received by a wireless LAN interface (I/F) 17 using a wireless LAN antenna 18. When the received data are image data after being subjected to data compression such as a JPEG file, document data such as a PDF file, slide image data used by a specified application program such as for presentation, and the like, a decoder 19 decodes these data, generates image data suitable for projection, and sends the image data to the scaler 12.

Further, when image data are input through the image input unit 11, a character recognition unit 20 performs character recognition processing on the image data so that information on font sizes of various characters used in each image, and the like can be obtained together with character string recognition results.

The operation of all the above-mentioned circuits is controlled by a CPU 21. This CPU 21 is connected to a main memory 22 and an SSD (Solid State Drive) 23 through the bus B. The main memory 22 is, for example, an SRAM, which functions as a working memory of the CPU 21. The SSD 23 is an electrically rewritable nonvolatile memory, which stores operation programs executed by the CPU 21, various fixed form data, and the like. The CPU 21 uses the main memory 22 and the SSD 23 to perform an overall control operation inside this projector 1.

The CPU 21 performs various projection operations according to key operation signals from a key operation unit 24. This key operation unit 24 includes a key operation part provided on the body of the projector 1, and an infrared receiver part which receives infrared light from an unillustrated remote control dedicated to this projector 1, to output, to the CPU 21 through the bus B, a key operation signal based on a key operated by a user on the key operation part of the body or on the remote control.

Further, an acceleration sensor 25 is connected to the bus B. This acceleration sensor 25 is, for example, a triaxial acceleration sensor to detect the direction of the acceleration of gravity in a state where the projector 1 is set up so that the set-up attitude of the projector 1 can be detected.

Note that the hardware circuit structure of each of the PCs 2A to 2D is assumed to be generally well known in the art, and the illustration and description thereof will be omitted. A presentation program as one of application programs is installed on at least one of these PCs 2A to 2D so that a document file (presentation file) created for the program can be played back.

Next, the operation of the embodiment will be described.

In the projector 1 of the embodiment, it is assumed that a size adjustment mode to adjust, to the input of each image signal from each of the plurality of personal computers or the like, the size of each image to be projected, and a normal mode not to adjust the size of each image to be projected are selectable.

Figure 3:
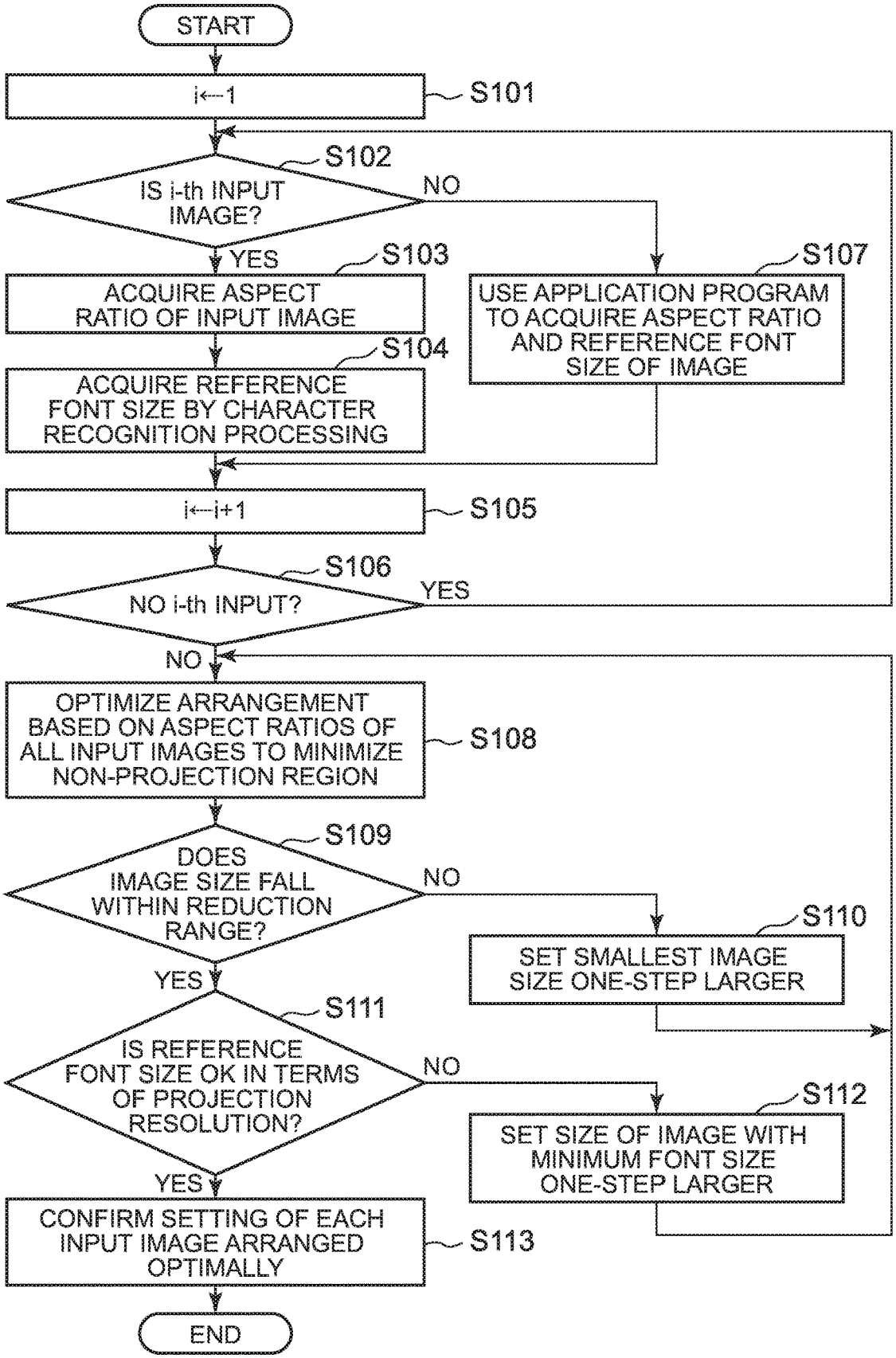
FIG. 3 is a flowchart illustrating the details of setting processing to change the arrangement and size of a composite image according to the embodiment.

FIG. 3 is a flowchart illustrating the details of setting processing to change the arrangement and size of a composite image, which is performed by the CPU 21 at the beginning of the projection operation in the size adjustment mode.

At the beginning, the CPU 21 sets an initial value "1" to a variable i used to select an external apparatus from which an image signal is input (step S101).

As the order of identifying external apparatuses from which image signals are input, for example, it is assumed that external apparatuses wire-connected to the image input unit 11 are first determined, and external apparatuses wirelessly connected through the wireless LAN interface 17 and the wireless LAN antenna 18 are determined later. However, the order of these external apparatuses can be changed optionally by the user.

According to the variable i, it is determined whether the i-th image signal input through the image input unit 11 or the wireless LAN interface 17 is input of an image without any change, such as RGB input, video signal input, or HDMI (registered trademark) input, or the i-th image signal is input in a file data format of application software, such as word-processing software, spreadsheet software, or presentation software (step S102).

Here, when it is determined that image data are input without any change (Yes in step S102), the CPU 21 acquires an aspect ratio from the number of long-side and short-side pixels that constitute the input image data (step S103).

Then, the CPU 21 acquires respective size information on the maximum font size, the minimum font size, and the most frequent font size, by causing the character recognition unit 20 to clip each text part from the input image data and perform character recognition so as to detect the size of each character in the image.

Note that it may also be determined whether respective input sources of the plurality of image signals input through the image input unit 11 are "only image" or "image with text." Even if "only image" and "image with text" are in the same aspect ratio, the region (area) of "only image" in a display unit can be reduced compared with the region (area) of "image with text." When the magnification of the region (area) of "image with text" in the display unit is reduced, if the magnification is reduced too much, the font size will become smaller than a threshold value, making it difficult to read. On the other hand, in the case of "only image," even if the reduction ratio is set to the same reduction ratio as that of the region (area) of "image with text," the image will not be difficult to recognize because it is just the image.

Based on the acquired respective size information, the CPU 21 acquires a font size as a reference in the image (step S104). For example, when the minimum font size is set as this reference font size, the image is projected in such a state that all characters in the image are readable without fail.

Alternatively, the most frequent font size may be set as the reference font size. In this case, although there is a possibility that characters of the minimum font size will be unreadable on a projection screen, when it is determined that characters cannot be projected accurately, the font size can be increased by one, such as to change the minimum font size to 11 point size when the minimum font size is 10.5 point size, to realize an environment where characters in an image are easy to read over the entire screen.

Next, the CPU 21 sets a "+1" update of the value of the variable i (step S105), and based on whether the i-th image after being subjected to the update setting is not input, determines whether the acquisition of information on the input of each image is completed (step S106).

When determining that the i-th image after being subjected to the update setting is input and that the acquisition of image information is not completed (Yes in step S106), the CPU 21 returns to the processing step S102 to continue the same processing.

In step S102 mentioned above, when determining that the input image signal is input in the form of file data of application software, rather than the input of the image without any change (No in step S102), the CPU 21 uses a corresponding application program to cause the decoder 19 to acquire, from input data, the aspect ratio of the image in the file data, and respective size information on the maximum font size, the minimum font size, and the most frequent font size of each text data part in order to acquire a reference font size (step S107).

Also here, the reference font size is so preset that either one of the minimum font size and the most frequent font size will be acquired.

After the reference font size is acquired, the CPU 21 proceeds to the processing step S105.

Thus, the aspect ratio and the reference font size of each image from each of external apparatuses from which images without any change are input are acquired in the processing steps S103 and S104, while the aspect ratio and the reference font size of each image from each of external apparatuses from which images are input in the form of file data of application software are acquired in the processing step S107 from data described in the program.

After completion of the acquisition of information on the aspect ratio and the reference font size of input from all the connected external apparatuses, for example, from the four PCs 2A to 2D, and the value of the variable i is subjected to the "+1" update setting to be set to "5" (step S105), when it is determined that there is no fifth input (No in step S106), the CPU 21 arranges all input images while enlarging/reducing the split range of each of the images based on the aspect ratio of each image to optimize the arrangement of the images to minimize the non-projection regions (step S108).

Figure 4:
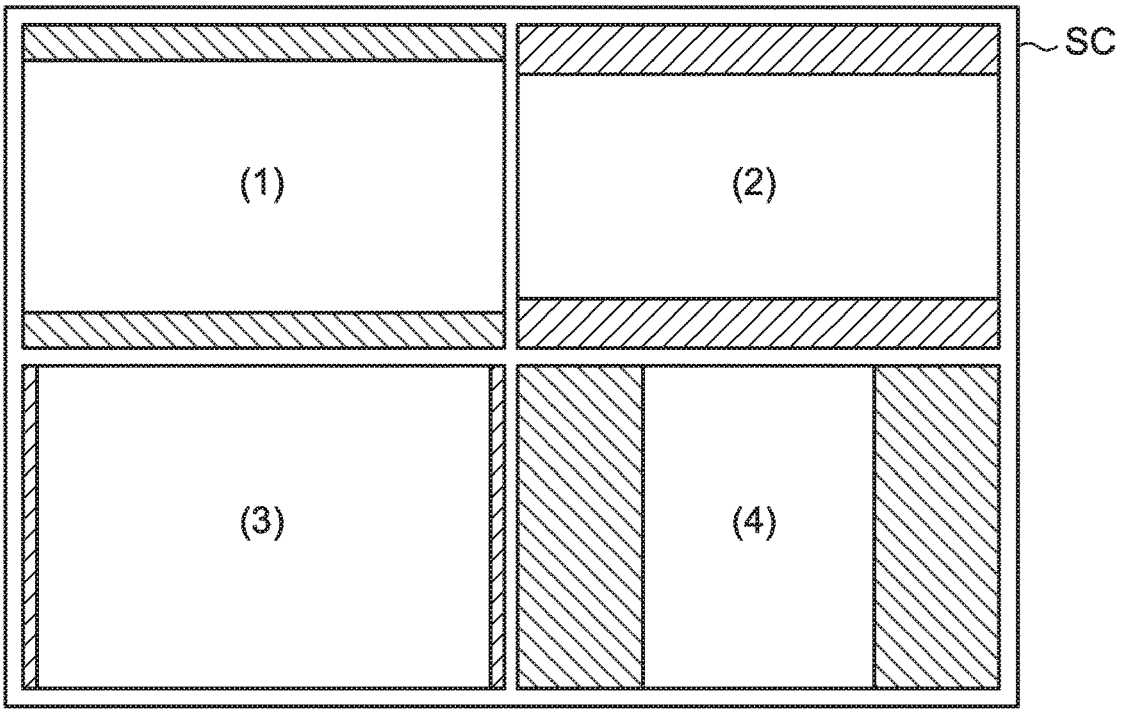
FIG. 4 is a diagram illustrating an example of a split projection state of four images in a normal mode according to the embodiment.

FIG. 4 illustrates an example of a state where the projection unit 14 projects images on the screen SC on the assumption that, when the normal mode not to adjust the size of each projected image is set without performing processing in the size adjustment mode of FIG. 3, respective images from the PCs 2A to 2D are separated equally into regions on the screen.

When the aspect ratio of an image of each input image signal is different from the aspect ratio of each equally-split region, the images cannot be projected without any non-projection region. Therefore, as illustrated in FIG. 4, image (1) to image (4) are all projected with non-projection regions indicated by hatching.

Especially, in the case of image (4) having a vertically long aspect ratio, since the equally-split projection region assigned to each image has a horizontally long aspect ratio, the area of right and left non-projection regions will become very large even if the image (4) is arranged at full length in the longitudinal direction.

Figure 5:
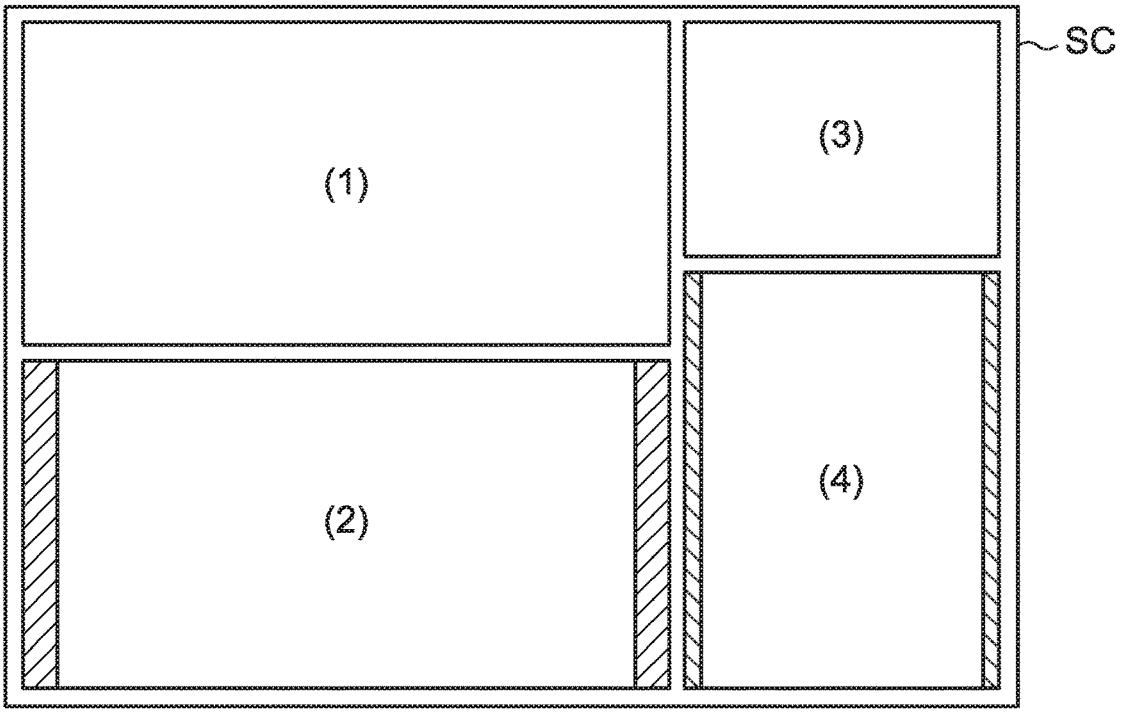
FIG. 5 is a diagram illustrating an example of the split projection state of four images in a size adjustment mode according to the embodiment.

On the other hand, an example of a state where the arrangement and the size are adjusted in the above-mentioned processing step S108 of FIG. 3 to perform optimization to minimize the non-projection regions is illustrated in FIG. 5.

In FIG. 5, the positions of image (2) and image (3) in FIG. 4 are replaced with each other, and image (1), image (2), and image (4) are enlarged, and image (3) is reduced, compared with the equally-split case. Further, non-projection regions do not exist in the split projection regions of image (1) and image (3), and the area of non-projection regions in the split projection regions of image (2) and image (4) become very small.

After the optimum arrangement as described above in step S108 is made, the CPU 21 sets, as "100," an actual projection area of each arranged image except the non-projection regions with respect to the actual area of the arranged image within a preset reduction range, for example, when the screen is split equally into projection regions in the normal mode to determine whether there is no image reduced too much depending on whether there is no image whose area is less than "60" corresponding to minus 40% (step S109).

Here, when determining that the actual area of at least one of the arranged images does not fall within the preset reduction range and that the image is reduced too much (No in step S109), the CPU 21 resets the image determined to be reduced too much to increase by one step, such as 2.5[%] from the actual image area optimized in the previous step S108 based on the actual area of the image, for example, at the time of equally splitting (step S110), and proceeds to step S108 while maintaining the reset condition to perform processing to obtain the optimum arrangement again.

Thus, the processing steps S108, S109, and S110 can be repeatedly executed as necessary to configure such a setting that there is no image reduced too much although the area of non-projection regions is increased little by little.

In step S109, when determining that there is no image reduced too much (Yes in step S109), the CPU 21 then determines whether the reference font size of each image enlarged or reduced by the optimum arrangement is compatible with the projection resolution of the projection unit 14 (step S111).

In other words, based on the enlargement/reduction ratio of each image optimally arranged at the time and the reference font size of each image, the CPU 21 determines in step S111 whether the result of multiplying the reference font size of an image having the smallest reference font size by the enlargement/reduction ratio at the time is compatible with the resolution of the projection unit 14, i.e., whether the reference font size is projectable.

When determining that the reference font size falls below a projectable range and hence characters cannot be projected accurately (No in step S111), the CPU 21 makes the font size one-step larger, such as to change the font size to 11 point size when the reference font size of the image at the time is 10.5 point size, to reset the image using a new enlargement/reduction ratio (step S112), and proceeds to step S108 while maintaining the reset condition to perform processing to obtain the optimum arrangement again.

Thus, the processing steps S108, S109, S111, and S112 are repeatedly executed as necessary so that only images compatible with the projection resolution of the projection unit 14 and including characters readable without fail will be arranged although the area of non-projection regions is increased little by little.

In step S111, when determining that the reference font size of each enlarged or reduced image is compatible with the projection resolution of the projection unit 14 (Yes in step S111), the CPU 21 confirms the setting of each input image on the assumption that the optimum arrangement of the plurality of images at the time is completed and configures the setting in the scaler 12 (step S113). Thus, the processing of FIG. 3 is ended to move to the actual projection operation on the assumption that the initial settings are completed.

As described in detail above, according to the embodiment, the area of non-projection regions can be reduced as much as possible according to the plurality of input image signals to make effective use of the area of the screen.

Further, in the aforementioned embodiment, the range of enlarging/reducing each image when the screen is split equally is limited to avoid making the areas of the plurality of images extremely unbalanced so that natural images easy to see can be provided.

Further, in the aforementioned embodiment, since the size of each image is adjusted in consideration of the projection resolution of the projection unit 14 so that the image will be projected in such a state that the reference font size of each arranged image is readable without fail, image quality when document images with character information particularly emphasized are projected can be ensured.

Further, in the aforementioned embodiment, when images are input as signals without any change, such as RGB input, video signal input, or HDMI (registered trademark) input as illustrated above, since characters and the font size thereof in each image are recognized by the character recognition processing, the input of these image signals can be supported.

Although there is no mention in the aforementioned embodiment, such an environment that images are projected at an oblique angle at which the projection optical axis is not orthogonal to the screen, rather than that the images are projected in a state where the projector 1 directly faces the screen SC, is also considered.

In this case, many machines have a trapezoid correction function to avoid such a trapezoid projection on a projection surface that the projection range on a side away from a projection device becomes wider.

In this trapezoid correction function, a display element unit to form an optical image in advance is used to limit a display range to make the optical image inverted trapezoid so that the rectangular shape of each image projected on the projection surface will be maintained. As a result, the resolution is made lower as the projection surface is located farther away from the projection device.

Therefore, when the enlargement/reduction ratio of each image is set in consideration of the reference font size and the projection resolution, the reduction ratio of the image can be particularly limited in consideration of a decrease in resolution when the trapezoid correction function is performed to avoid the deterioration of the image quality of projection.

In the aforementioned embodiment, the present invention is applied to the projector to which the plurality of personal computers are wire-connected or wirelessly connected to project the plurality of images onto a screen as a non-projection target. However, the present invention is not limited thereto, and the same applies even to an application program or the like to synthesize and display images posted from a plurality of smartphones on a screen of one tablet terminal.

In this regard, when a composite image is generated from images extremely different in aspect ratio from one another, such as a case where a vertically long image of a strip of paper on which a haiku Japanese poem is brush-written is mixed, as well as when vertically long images and horizontally long images similar in aspect ratio to one another are mixed as a whole, wasteful display regions can be excluded as much as possible according to the technique of the present invention.

Even when a plurality of image signals input through the input unit are different in aspect ratio from one another, the present invention can maximize the pixel usage of the plurality of images on the display unit and minimize ineffective portions as regions which are not displayed as images on the display unit.

The present invention is not limited to the aforementioned embodiment, and various modifications are possible in the implementation phase without departing from the scope of the invention. Further, the embodiment and modifications may be combined as appropriate. In such a case, a combined effect can be obtained. Further, various inventions are included in the aforementioned embodiment, and the various inventions can be extracted from selected combinations of a plurality of disclosed constituent features. For example, the problem can be solved even when some of all constituent features described in the embodiment are deleted, and such a configuration that these constituent features are deleted can be extracted as an invention as long as the effect can be obtained.

In the following, the invention as set in the scope of the claims in the original specification will be noted.

A storage medium readable by a computer incorporated in a device including an input unit used to input a plurality of image signals from a plurality of external apparatuses and a display unit which displays images, the computer being caused to function as:

a setting unit which sets a display condition of each of the plurality of images based on an aspect ratio corresponding to each of the plurality of image signals input through the input unit; and a display control unit which generates a composite image from the plurality of image signals input through the input unit based on the contents set by the setting unit, and displays the composite image on the display unit.

What is claimed is (US):

1. A display device comprising:

an input unit used to input a plurality of image signals from a plurality of external apparatuses;

a display unit;

a setting unit which sets, for each of a plurality of images respectively corresponding to the plurality of image signals input through the input unit, (i) a position arrangement and (ii) an enlargement/reduction ratio, based on an aspect ratio of the image, so as to minimize an area of non-display regions when display is performed based on the plurality of image signals; and a display control unit which generates a composite image from the plurality of image signals input through the input unit based on contents set by the setting unit, and controls the display unit to display the composite image, wherein the setting unit performs optimization to set at least one of (i) positions of a first image and a second image among the plurality of images such that the first image is arranged next to the second image in a same row along a given direction, the first image and the second image having a largest and second largest width to height ratio among the plurality of images, respectively, and (ii) positions of a third image and a fourth image among the plurality of images such that the third image is arranged next to the fourth image in a same row along the given direction, the third image and the fourth image having a largest and second largest height to width ratio among the plurality of images, respectively, and wherein, when an actual display area of one of the first to fourth images after performing the optimization is determined to be less than a predetermined percentage with respect to an actual display area of a corresponding one of the first to fourth images when a display region is equally split, the setting unit resets the actual display area of the one of the first to fourth images by increasing the actual display area of the one of the first to fourth images by a preset percentage and performs the optimization again.

2. The display device according to claim 1, wherein the setting unit limits at least one of the enlargement ratio and the reduction ratio of the image.

3. The display device according to claim 2, wherein the setting unit limits the reduction ratio of the image based on a font size of characters included in the image and a display resolution of the display unit.

4. The display device according to claim 3, further comprising a character recognition unit which recognizes characters and a font size of the characters from an image corresponding to an image signal input through the input unit, wherein the setting unit limits the reduction ratio of the image based on the font size recognized by the character recognition unit and the display resolution of the display unit.

5. The display device according to claim 4, wherein:

the display unit comprises a projection unit having a trapezoid correction function, and the setting unit limits the reduction ratio of the image in consideration of a deterioration in display resolution when the trapezoid correction function is performed.

6. The display device according to claim 3, wherein:

the display unit comprises a projection unit having a trapezoid correction function, and the setting unit limits the reduction ratio of the image in consideration of a deterioration in display resolution when the trapezoid correction function is performed.

7. The display device according to claim 1, wherein the setting unit limits the reduction ratio of the image based on a font size of characters included in the image and a display resolution of the display unit.

8. The display device according to claim 7, further comprising a character recognition unit which recognizes characters and a font size of the characters from an image corresponding to an image signal input through the input unit, wherein the setting unit limits the reduction ratio of the image based on the font size recognized by the character recognition unit and the display resolution of the display unit.

9. The display device according to claim 8, wherein:

the display unit comprises a projection unit having a trapezoid correction function, and the setting unit limits the reduction ratio of the image in consideration of a deterioration in display resolution when the trapezoid correction function is performed.

10. The display device according to claim 7, wherein:

the display unit comprises a projection unit having a trapezoid correction function, and the setting unit limits the reduction ratio of the image in consideration of a deterioration in display resolution when the trapezoid correction function is performed.

11. A display method for a device including (i) an input unit used to input a plurality of image signals from a plurality of external apparatuses and (ii) a display unit, the display method comprising:

setting, for each of a plurality of images respectively corresponding to the plurality of image signals input through the input unit, (i) a position arrangement and (ii) an enlargement/reduction ratio, based on an aspect ratio of the image, so as to minimize an area of non-display regions when display is performed based on the plurality of image signals;

generating a composite image from the plurality of image signals input through the input unit based on contents set in the setting; and controlling the display unit to display the composite image, wherein the setting comprises performing optimization to set at least one of (i) positions of a first image and a second image among the plurality of images such that the first image is arranged next to the second image in a first row along a given direction, the first image and the second image having a largest and second largest width to height ratio among the plurality of images, respectively, and (ii) positions of a third image and a fourth image among the plurality of images such that the third image is arranged next to the fourth image in a second row different from the first row along the given direction, the third image and the fourth image having a largest and second largest height to width ratio among the plurality of images, respectively, and wherein, when an actual display area of one of the first to fourth images after performing the optimization is determined to be less than a predetermined percentage with respect to an actual display area of a corresponding one of the first to fourth images when a display region is equally split, the setting resets the actual display area of the one of the first to fourth images by increasing the actual display area of the one of the first to fourth images by a preset percentage and performs the optimization again.

12. A non-transitory storage medium storing a program readable by a computer incorporated in a device including (i) an input unit used to input a plurality of image signals from a plurality of external apparatuses and (ii) a display unit, the computer operating under control of the program to execute processing comprising:

a setting process which sets, for each of a plurality of images respectively corresponding to the plurality of image signals input through the input unit, (i) a position arrangement and (ii) an enlargement/reduction ratio, based on an aspect ratio of the image, so as to minimize an area of non-display regions when display is performed based on the plurality of image signals; and a display control process which generates a composite image from the plurality of image signals input through the input unit based on contents set in the setting process, and controls the display unit to display the composite image, wherein the setting process performs optimization to set at least one of (i) positions of a first image and a second image among the plurality of images such that the first image is arranged next to the second image in a first row along a given direction, the first image and the second image having a largest and second largest width to height ratio among the plurality of images, respectively, and (ii) positions of a third image and a fourth image among the plurality of images such that the third image is arranged next to the fourth image in a second row different from the first row along the given direction, the third image and the fourth image having a largest and second largest height to width ratio among the plurality of images, respectively, and wherein, when an actual display area of one of the first to fourth images after performing the optimization is determined to be less than a predetermined percentage with respect to an actual display area of a corresponding one of the first to fourth images when a display region is equally split, the setting process resets the actual display area of the one of the first to fourth images by increasing the actual display area of the one of the first to fourth images by a preset percentage and performs the optimization again.

* * * * *